US007591468B2

(12) United States Patent
Ryan et al.

(10) Patent No.: US 7,591,468 B2
(45) Date of Patent: Sep. 22, 2009

(54) LOW NOISE COMPILE PADDLES

(75) Inventors: Jeffrey W. Ryan, Knebworth (GB); David Thomas, High Wycombe (GB)

(73) Assignee: Xerox Corporation, Norwalk, CT (US)

( * ) Notice: Subject to any disclaimer, the term of this patent is extended or adjusted under 35 U.S.C. 154(b) by 206 days.

(21) Appl. No.: 11/824,671

(22) Filed: Jul. 2, 2007

(65) Prior Publication Data

US 2009/0008872 A1 Jan. 8, 2009

(51) Int. Cl.
*B65H 29/40* (2006.01)

(52) U.S. Cl. ..... 271/306; 271/187

(58) Field of Classification Search ..... 271/187, 271/306

See application file for complete search history.

(56) References Cited

U.S. PATENT DOCUMENTS 3,847,388 A * 11/1974 Lynch ..... 271/306
4,750,726 A * 6/1988 Looney ..... 271/10.03
4,770,405 A * 9/1988 Fukushima et al. ..... 271/176
4,969,641 A * 11/1990 Fukushima et al. ..... 271/187
5,098,080 A * 3/1992 Arnone et al. ..... 271/187
5,145,167 A * 9/1992 McGraw et al. ..... 271/186
5,545,882 A * 8/1996 Tanaka ..... 235/98 R
6,273,663 B1 * 8/2001 Pickering et al. ..... 414/27
6,341,776 B1 * 1/2002 Whitten ..... 271/187
6,575,461 B1 * 6/2003 Rider ..... 271/315
6,676,124 B1 * 1/2004 Wirtz ..... 271/236
2001/0020768 A1 * 9/2001 Duhamel et al. ..... 271/264
2002/0063378 A1 * 5/2002 Dobrindt ..... 271/187
2003/0021659 A1 * 1/2003 Michler ..... 414/315
2005/0040589 A1 * 2/2005 Siemer et al. ..... 271/306
2007/0057443 A1 * 3/2007 Terao et al. ..... 271/221
2008/0001352 A1 * 1/2008 Jeong ..... 271/306
2008/0136090 A1 * 6/2008 Bober ..... 271/221

FOREIGN PATENT DOCUMENTS

JP 02188365 A * 7/1990
JP 2005263446 A * 9/2005

* cited by examiner

*Primary Examiner*—Patrick H Mackey
*Assistant Examiner*—Howard Sanders
(74) *Attorney, Agent, or Firm*—James J. Ralabate

(57) ABSTRACT

A flexible blade for use in a paddle wheel drive element is disclosed. This flexible blade, usually made from rubber or other flexible materials is horizontally split into two sections to provide reduced audible noise when the blade contacts and moves paper sheets.

8 Claims, 7 Drawing Sheets

LOW NOISE COMPILE PADDLES

This invention relates to media or paper moving marking systems and apparatus and, more specifically, to a finishing compiling structure useful in said systems.

BACKGROUND

Marking systems that transport paper or other media are well known in the art. These marking systems include electrostatic marking systems, non-electrostatic marking systems, printers or any other marking system where paper or other flexible media or receiving sheets are transported internally to a an output device such as a finisher and compiler. Many machines are used for collecting or gathering printed sheets so that they may be formed into books, pamphlets, forms, sales literature, instruction books and manuals and the like.

The finisher and compiler are located at a site in these marking systems after the receiving sheets (paper) have been marked. A finisher is generally defined as an output device that has various post printer functions or options such as hole punching, corner stapling, edge stapling, sheet and set stacking, letter or tri-folding, Z-Folding, Bi-folding, signature booklet making, set binding [including thermal, tape and perfect binding], trimming, post process sheet insertion, saddle stitching and others.

The compiler often employs a compiling wall or tray where frictional drive elements hereinafter paddle wheels with elastomeric blades or "paddle wheels" (PW) are used to drive sheets (paper) against the compiling wall for registration of the staple or bind edge of a set. The force of these frictional drive elements on the sheet is critical and, must be controlled within narrow limits. In the case of Deflection Loaded technologies such as Paddle Wheels, the compiler element drive force has been found to be dependent on the type of wheel used and the type of elastomeric blades on the paddle wheel.

The compiling capacity and bind edge sheet registration can be compromised with moderate to severe curl on the sheets if improper wheels and blades are used. The curl can be concave up or concave down and curl build-up generally progressively increases as the paper stack height grows. Excessive curling caused by poor blade performance can cause poor set registration and possibly paper jams or sheet damage.

As discussed above in [003] finisher compiling systems often employ frictional drive elements such as elastomeric paddle wheels to drive the individual sheets square (deskewed) and against the registration edge. With such compliant drive elements, the normal force on the paper and, thus, the drive force and noise generated thereby will increase as the paper builds up in the compiler tray. As the distance between the shaft and the top of the paper stack decreases, the deflection of the rubber blades increases and with it the noise and drive forces that are transmitted to the top sheet of the stack. As the paddle blade contacts the paper, a significant audible noise is produced as blade-paper contact occurs. A solution to this excessive audible noise produced by existing print art paddles is needed for the HVF to meet specified noise allowance for the product(s).

A rapid increase in on-demand service to provide large-volume small-scale printing of brochures etc. by use of color/black and white multifunction machines has been exhibited. Even ordinary offices are stepping up their efforts at in-house production of conference paper, simple booklets, manuals and other materials by establishing service departments for intensively processing prints in large quantities. Noise levels in these type systems have become very important since the office space is relatively small and noise can be magnified. Such customers require relatively quiet post-processing functions such as high-speed/high-precision punching, stapling and paper folding work with simultaneous print output and realization of high-speed/high-quality print output with a high degree of reliability.

"Drive elements or frictional drive elements" as used in this disclosure and claims include any suitable paddle wheel and blade used. Also, in the present embodiments, any number of paddle wheels and any suitable number of rubber paddle wheel blades may be used. The size, type and number of paddle wheels and blades, for best results, depend upon many variations in the paper used such as size of paper, weight of paper, coated or non-coated paper, paper for color prints, paper for monochrome prints, etc and the specific compiler tray geometry. Also, curl suppressors can be desirably used together with the paddle wheels to improve paper registration. The desired or ideal drive force and generated noise of the blades in the paddle wheels will, of course, vary as the conditions, paper and paper size and other variables change or exist; the ideal drive force and noise levels produced can be easily established and acted on through simple tests.

SUMMARY

Embodiments of this invention takes an existing compiling paddle wheel mechanism and by changing the construction of the paddle blade from a solid form to a horizontally split form, significantly reduces the audible noise produced by the blade as it contacts the paper. This provides a simple solution to excessive audible noise produced by the existing prior art paddles which leads to the HVF (high volume finisher) not meeting the specified audible noise allowance for the product(s).

This solution enables the paddle compiling technology to be extended to larger and faster machines by keeping noise levels down. This invention takes an existing compiling paddle mechanism and by changing the construction of the paddle blade from a solid form to a horizontally split form, significantly reduces the audible noise produced by the blade as it contacts paper. The noise level produced is lowered due to the bottom section of the paddle impacting the sheet and absorbing energy before toughing the top section and allowing the full drive force of the paddle to operate on the sheet during compiling.

The split paddle blade of this invention reduces noise significantly and ideally is used on all paddle wheels in the system. A mixture of split and non-split blades could be used, if desired, to maximize drive force while minimizing noise. Since the most noise generated comes from the longer of the two blades on a paddle wheel, at least this longer blade should be split, but best reduction in noise is obtained when both the longer and the shorter blades are split. While the blades are ideally split down the middle, it would be within the spirit of this invention if the split is present but not located in the middle to bisect the blade.

There were encouraging results of tests on noise reduction measurements with the split blades.

While in paddle compile systems there can be problems with both too much or too little drive force, the systems of the present invention provides proper drive force together with noise reduction. A balance of both split blades and non-split blades could be determined by trial and error to maximize both drive force and noise reduction.

In conventional compile systems using paddle wheels usually two blades are used, a longer blade and a shorter blade. In the embodiments of the present invention, any suitable number of blades; i.e. one or more blades may be used to reduce noise depending upon the degree of reduction desired.

The present embodiments provide a change to the existing compiler paddles of the high volume finisher (HVF). As earlier noted, the current paddle working at the required speeds for compiling does not meet the required audible noise specification. With the change in blade construction provided herein, this new configuration is quieter. The paddle system is comprised of a shaft with several paddle holders. Each holder or wheel has two paddle-blades attached at 180 degrees apart. Each paddle blade is a flexible rubber member of a specific width, length and thickness. These characteristics allow the paddle blade to contact paper and escort it toward the compiler edge. The new provided paddle blade is split in two, with the first half to contact the paper and absorb the impact. Due to its smaller size, the impact is quieter. The second half of the paddle then contacts the first and adds to the stiffness of the paddle. This increase in stiffness allows the paddle to function similarly to the current system. Our tests have shown to decrease noise by at least 10 db.

As earlier noted, any suitable number, type or size of split blades or paddles may be used in the present invention. Depending upon the paper or media sizes, finisher speed and other conditions, the appropriate blades and paddles can be selected. Any type or size or number of split blades can be used on a paddle, again depending upon the existing conditions of use. Split blades can be used in all or some of the compiling paddle mechanism; preferably, for best results, all paddle wheels will comprise split blades.

DETAILED DISCUSSION OF DRAWINGS AND PREFERRED EMBODIMENTS

Figure 1:
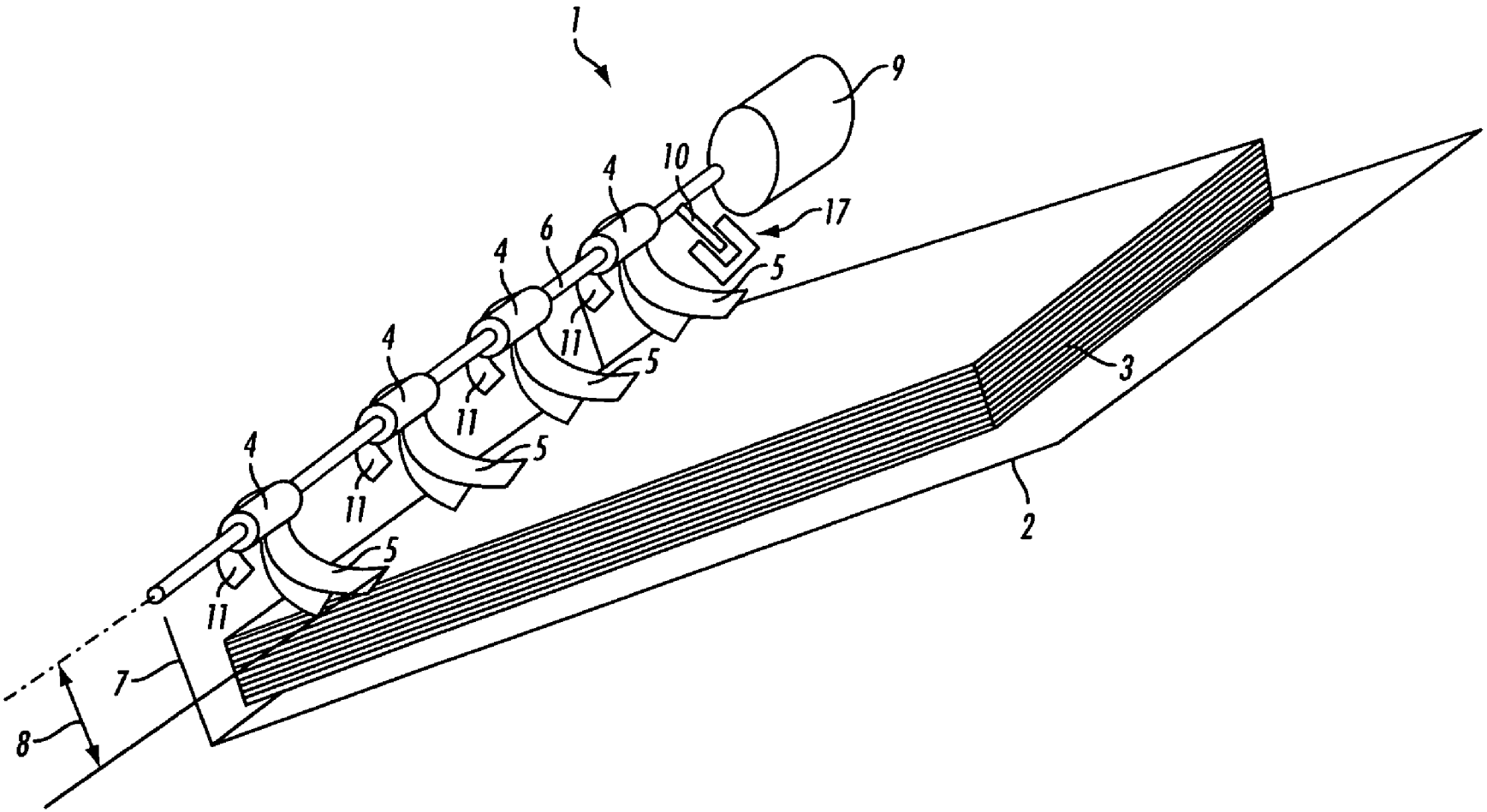
FIG. 1 illustrates an embodiment of a finisher compiling station using the improved split blades of this invention where only the longer blade is split.

In FIG. 1, a typical finisher-compiling station 1 is illustrated having a compiling tray 2 used to house and register paper stack 3 against the registration guide or compiling wall 7.

Above the paper stack 3 are paddle wheels or frictional drive elements 4 with split paddle blades 5 of this invention. The paddle wheels 4 are rotably mounted on drive shaft 6. The frictional drive paddle wheels drive sheets 3 against a compiling wall 7 for registration. The force and impact of these drive elements 4 on the sheet or sheets 3 can produce excessive noise in the prior art device. Embodiments of the present invention provides split blades 5 to significantly reduce this noise upon blade-sheet contact.

The speed of the drive motor 9 is a function of the torque load on the shaft 6. The drive motor 9 is in operational contact with at least one shaft position sensor 17 and appropriate software. A paddle wheel blade home position flag 10 is mounted on the drive shaft 6. A sensor 17 is mounted to the frame and is actuated by the passage of home position flag 10 once each shaft revolution. The flag 10 and sensor 17 are used to capture the time it takes to complete any given shaft revolution for the shaft speed calculation. Controlling compiler drive element torque and the use of split blades 5 is important to the present embodiments. A motor current sensor could also be used if suitable. Paddle wheels 4 have in an embodiment two sets of blades, first non-split shorter blades 11 and second longer split blades 5. However, as earlier mentioned, any suitable number of split blades and wheels 4 may be used. Also either or both blades 5 and 11 may be split. While it is preferred that both blades 5 and 11 be split, at least the longer blade 5 must be split to reduce noise as shown in FIG. 1.

Figure 2A:
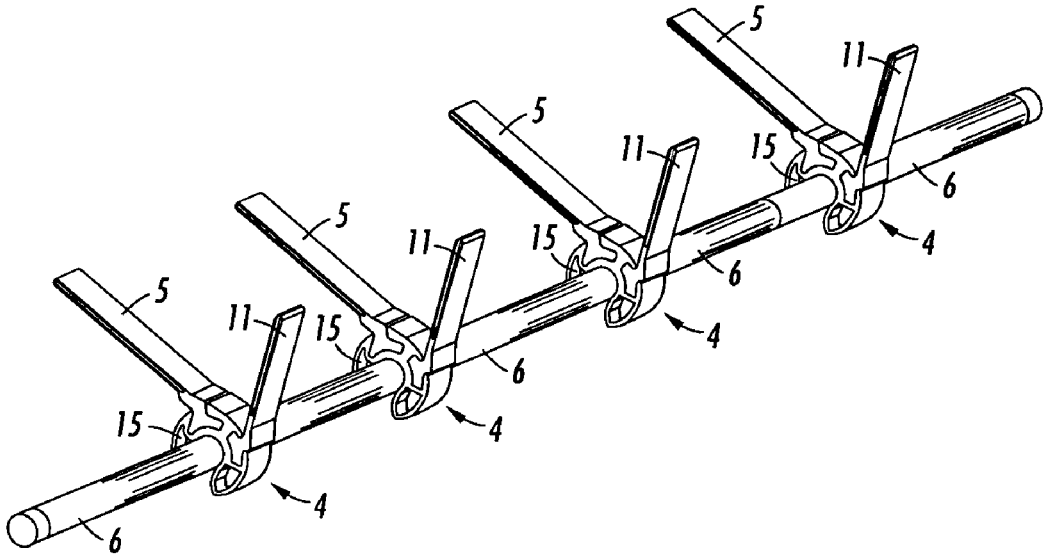
FIG. 2A illustrates a configuration of a paddle wheel shaft and hub of this invention with both longer and shorter blades split.

FIG. 2A shows a paddle wheel 4, shaft 6 and hub 15 useful in an embodiment of the present invention. In this particular embodiment, the hub 15 is integral with and connected to a longer split blade 5 and a shorter split blade 11 in a unitary configuration as shown. The shaft 6 rotates thereby rotating blades 11 and 5 to contact and register paper 3 against a compiling wall 7 (See FIG. 1).

Figure 2B:
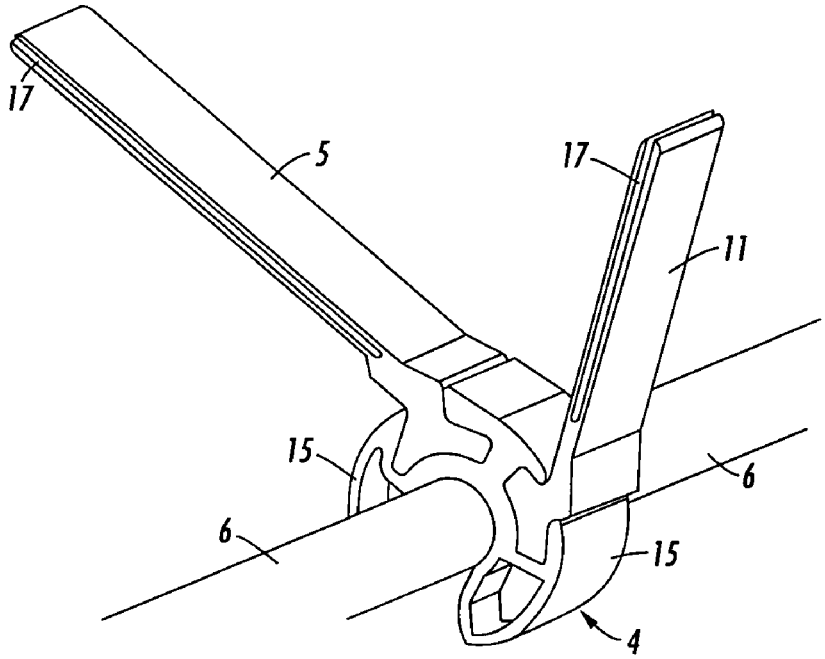
FIG. 2B illustrates a single paddle wheel on a shaft.

FIG. 2B illustrates a single paddle wheel 4 having a hub 15 connected to a longer split blade 5 and a shorter split blade 11 in a unitary configuration where the hub 15, the blades 5 and 11 are all in a one piece structure as shown. The blades in FIGS. 3-6 are for clarity are shown as merely split but each of FIGS. 3-6 have the configuration shown in FIGS. 2B and 7A. There is a slight space 17 between segments of the split blades 5 and 11. In FIG. 2B at least two blades 5 and 11 on one end are integrally connected to a hub 15 and on an opposite end are open or split ends thereby form ma a unitary structure. One or two of the split ends are configured to contact the top sheet of paper stack 3 and frictionally drive the top sheet against a compiling wall 7.

Figure 3:
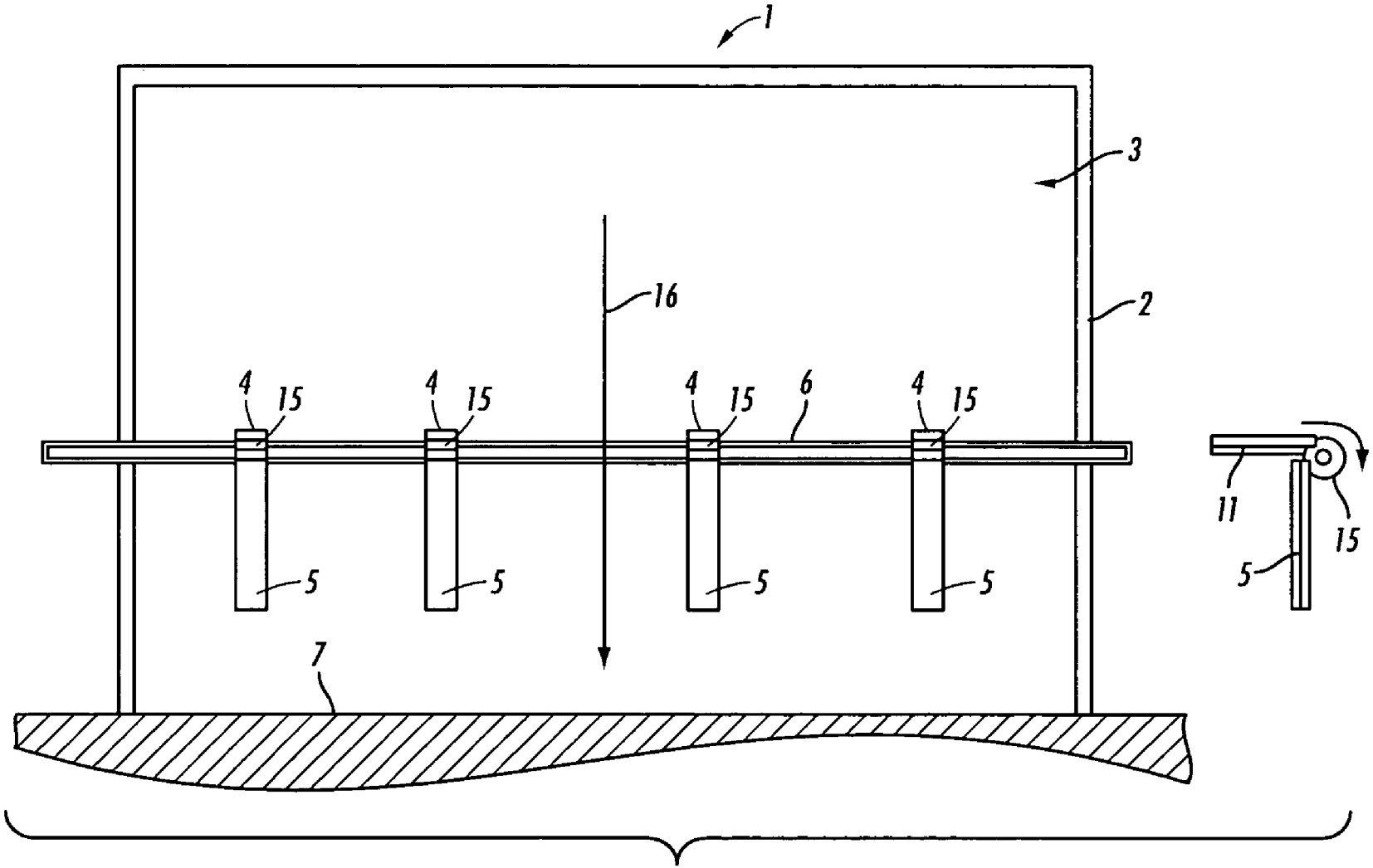
FIG. 3 is an embodiment using four paddle wheels with two split blades on each wheel.

FIGS. 3-6 illustrate various embodiments of the present invention. In FIG. 3 a top view of a finishing-compiling station 1 is shown having a drive shaft or paddle wheel shaft 6 having rotably mounted thereon four paddle wheels 4 with hub 15. In this embodiment, each paddle wheel 4 has two split blades, a first blade 11 and a second blade 5. The purpose of two split blades 5 and 11 is to increase the peak sheet drive force (occurs when both blades contact the sheet) and to extend the dwell time that the blade(s) are acting on the top sheet. These parameters are controlled by the number of blades per paddle wheel, the length of the individual blades and the angular position of the blades, one from the other. The compiling tray 2 has a compiling wall 7 against which the paper 3 is pushed for registration. (See FIG. 1).

Figure 4:
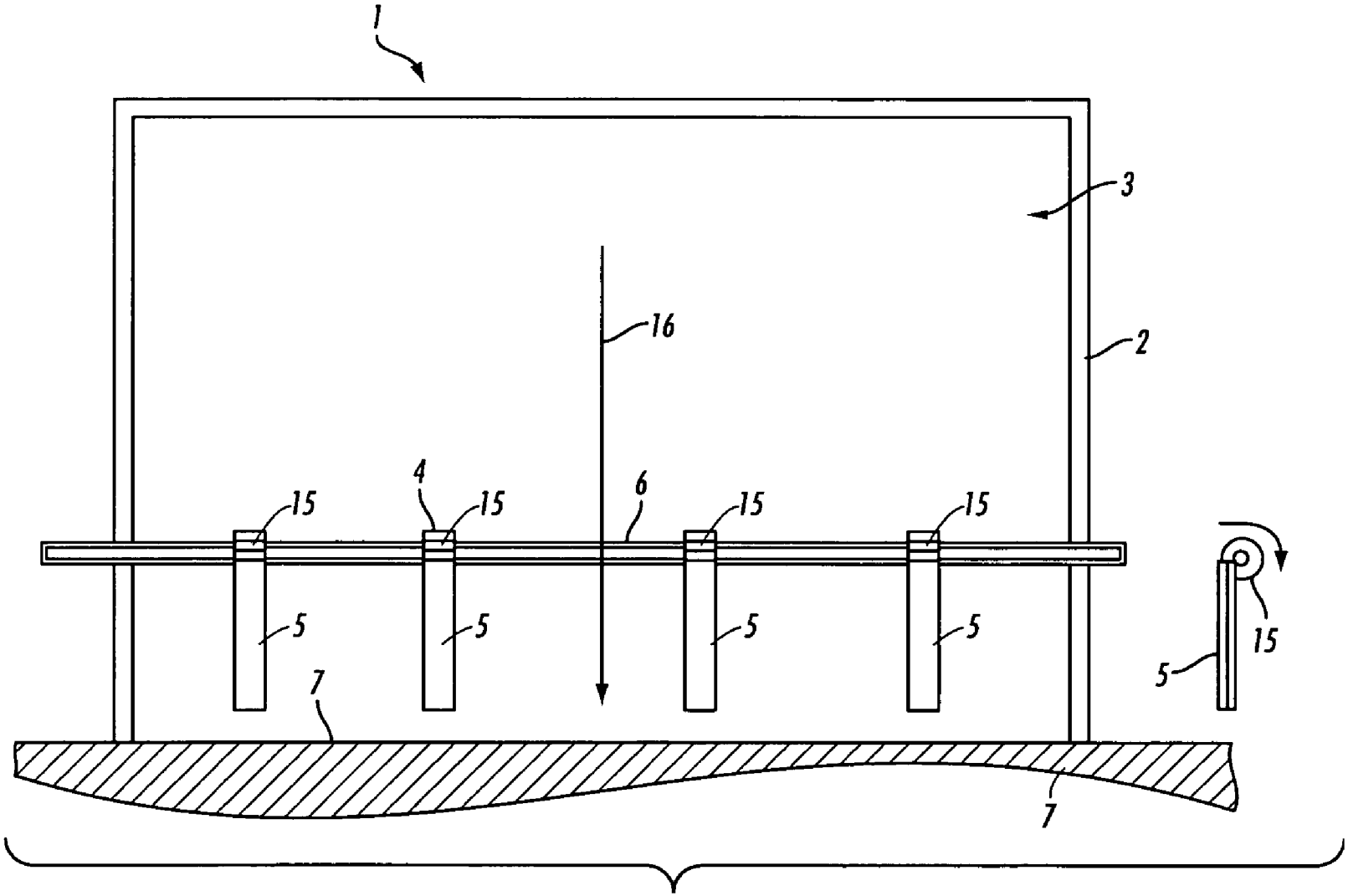
FIG. 4 is an embodiment using four paddle wheels with one split blade on each wheel.

FIG. 4 shows four paddle wheels 4 with one split blade 5 on each wheel 4. A registration edge or compiling wall 7 is used to align the papers in paper stack 3 after they are transported into compiling tray 2. The arrow 16 indicates the direction of the paper flow.

Figure 5:
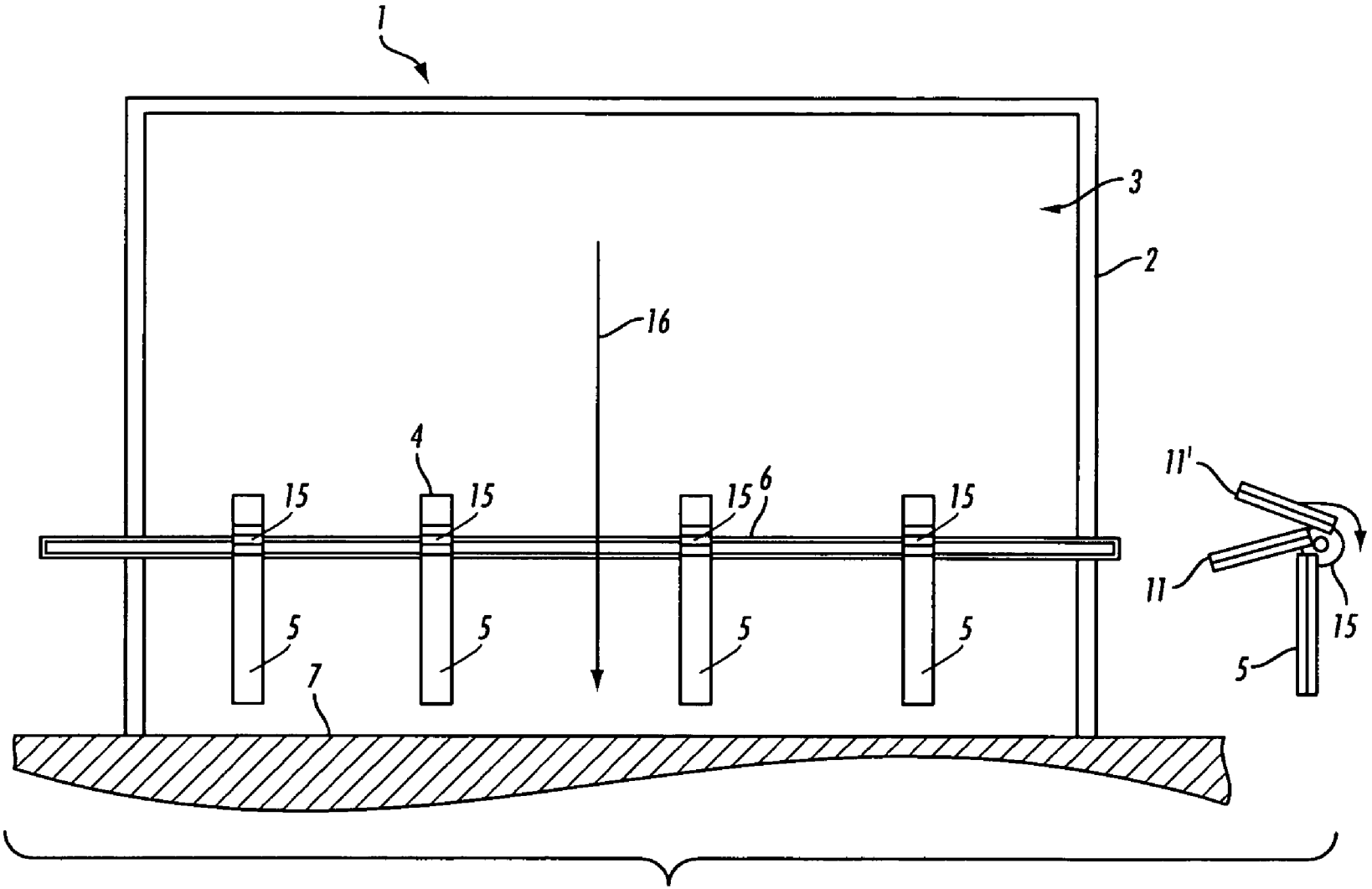
FIG. 5 is an embodiment using four paddle wheels with three split blades on each wheel.

In FIG. 5, the same finishing station 1 is shown as in FIGS. 3 and 4 except each paddle wheel 4 has three split blades 5, 11 and $\mathbf{11}^1$.

Figure 6:
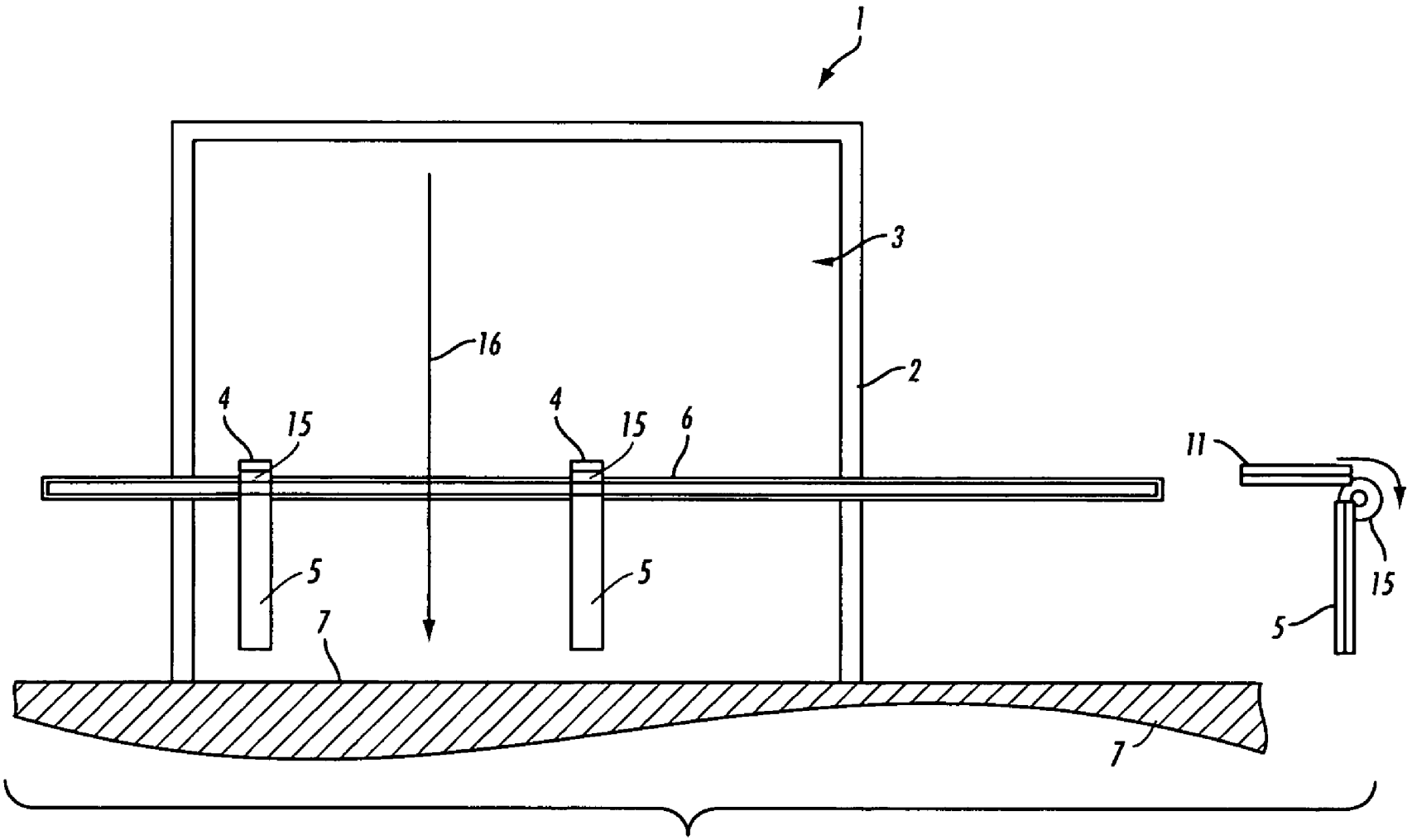
FIG. 6 is an embodiment using two paddle wheels with two split blades on each wheel.

In FIG. 6, the same finishing station 1 is shown as in FIGS. 3, 4, and 5 except that two paddles 4 are used with two split blades 5 and 11 on each wheel 4. Arrow 16 shows the direction of paper flow into tray 2.

Figure 7A:
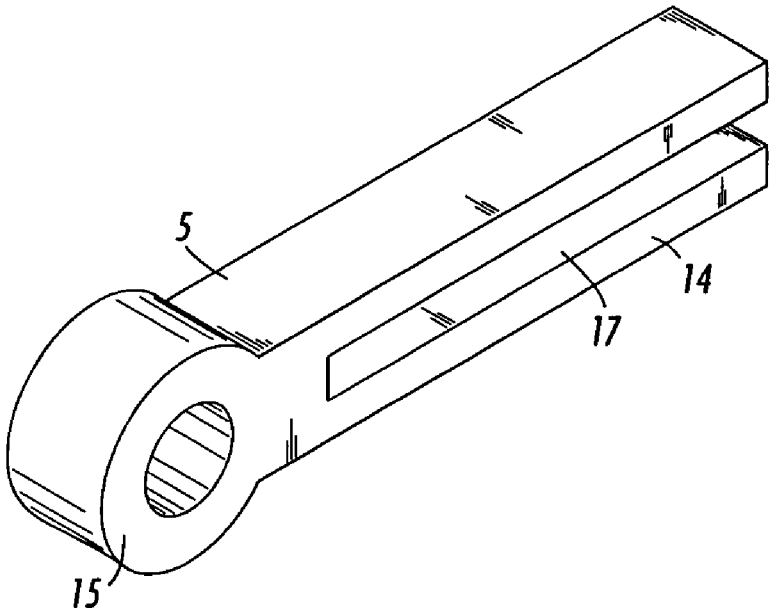
FIG. 7A illustrates an embodiment of the split paddle blade of this invention.
Figure 7B:
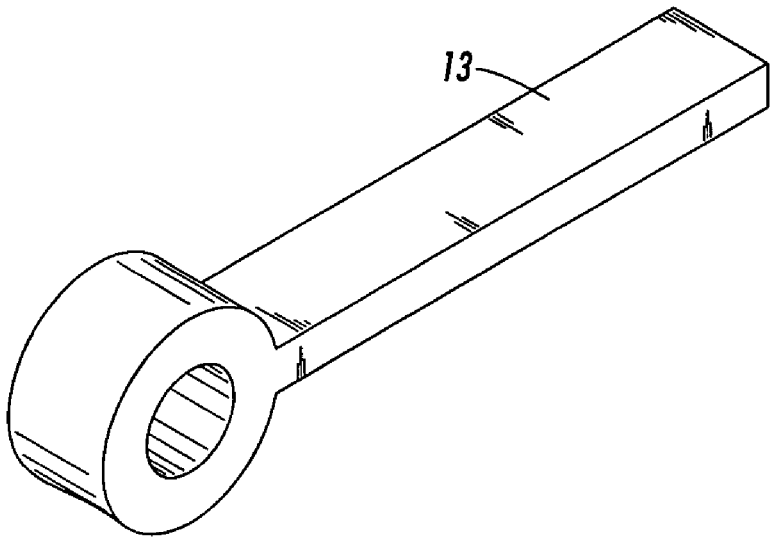
FIG. 7B PRIOR ART
FIG. 7B illustrates the paddle blade used in the prior art.

FIG. 7A illustrates the horizontally split form of an embodiment of the paddle blade 5 of this invention. Here, an existing compiling paddle blade 13 of the prior art shown in FIG. 7B is changed from its solid form to a horizontally split form shown in FIG. 7A. This significantly reduced the audible noise produced by the blade (f and/or 11) as it contacts paper. The noise level produced by the blade of 7A is lowered due to the bottom section 14 of the paddle impacting the sheet and absorbing energy before touching the top section and allowing the full drive force of the paddle to operate on the sheet during compiling. This is a solution to excessive audible noise produced by the existing paddle blades of FIG. 7B which leads to the HVF not meeting the specified audible noise allowance for the product(s).

In summary, the present embodiments provide a finisher compiling structure useful in a paper-handling system of a marking machine. This system comprises in an operative arrangement at least one variable speed drive shaft, at least one paddle wheel drive element(s) mounted to the drive shaft, and a compiler tray adapted to receive paper sheets driven into the tray by the paddle wheel drive element. The finisher is located in the marking machine after the paper sheets have been marked. The paddle wheel drive element comprises at least one horizontally split paddle blade flexibly attached to the drive shaft. The tray has a compiler wall which aligns the paper when the split paddle blade(s) drive the paper into the tray. At least two paddle wheel drive elements are used and at least two split paddle blades are used on each element. Each paddle wheel drive element has from 1-3 split paddle blades attached thereto. The paddle wheel drive element has two split paddle blades attached thereto, one of the blades being a longer of the two blades and the other of the blades being the shorter of the two blades.

Therefore, provided hereby is a finisher-compiling structure useful in a marking system for postmarking finishing operations or steps. The structure comprises in an operative arrangement a compiler tray, a drive shaft positioned above the tray, a source of power for the shaft, at least two drives and elements or paddle wheels rotably mounted on the drive shaft. Each of the paddle wheels have at least two horizontally split paddle blades. The paddle wheels are enabled to drive individual sheets of paper into a stack in the tray and against a registration-compiling wall of the tray. The split paddle blades are enabled to substantially reduce audible noise produced by the blades as they contact paper when driving the paper into the tray.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A finisher-compiling apparatus useful in a marking system for post marking finishing operations, said structure comprising:

a compiler tray with a compiler wall, a drive shaft positioned above said compiler tray, at least two separated paddle wheels or frictional drive elements comprising at least two blades and a hub that is rotably mounted on said drive shaft, said at least two blades integral with said hub in a unitary structure and at least one of said at least two blades being a longer blade and at least one shorter blade being shorter than other said at least two blades, at least said longer blade being a split paddle blade and configured to reduce noise upon frictional contact with a paper sheet of said apparatus, all of said at least two blades configured to contact a top sheet of a stack of paper and configured to frictionally drive sheets against said compiling wall for registration of said sheets, said split paddle blade comprising a top paddle section and a bottom paddle section, said bottom paddle section configured to first contact an upper sheet of said stack of paper before subsequent contact by said top paddle section thereby reducing a noise level produced by said contact.

2. The apparatus of claim 1 wherein said compiler tray has said compiler wall which aligns said paper sheet when said split paddle blade frictionally drives said paper into said compiler tray, said split blade configured to drive said paper sheet into said tray at a sufficient force to cause alignment while reducing any noise generated thereby.

3. The apparatus of claim 1 wherein said frictional drive elements comprise at least one shorter and one longer blade, at least one of said longer blades being split horizontally.

4. The apparatus of claim 1 wherein said shorter and said longer blades are all split horizontally to reduce noise generated thereby.

5. The structure of claim 1 wherein each paddle wheel drive element has from 2-3 split paddle blades attached thereto.

6. The structure of claim 1 wherein each paddle wheel has two separated blades attached thereto at about 180 degrees apart.

7. The apparatus of claim 1 wherein each split paddle blade comprises a flexible rubber or other flexible material adapted to frictionally contact a top sheet of paper in a stack and frictionally drive it toward and into said compiling wall.

8. The apparatus of claim 1 wherein said at least two blades on one end are integrally connected to said hub and on an opposite end are open or split ends thereby forming a unitary structure, at least one of said split ends configured to contact said top sheet of a stack of paper and frictionally drive said top sheet against a compiling wall for registration.

* * * * *